US007418842B2

(12) United States Patent
Cimetta et al.

(10) Patent No.: US 7,418,842 B2
(45) Date of Patent: Sep. 2, 2008

(54) CLOTHES WASHING MACHINE WITH IMPROVED FILTER ASSEMBLY

(75) Inventors: Silvano Cimetta, Treviso (IT); Simone Sacilotto, Azzano Decimo (IT)

(73) Assignee: Electrolux Home Products Corporation N.V., Zaventum (BE)

( * ) Notice: Subject to any disclaimer, the term of this patent is extended or adjusted under 35 U.S.C. 154(b) by 213 days.

(21) Appl. No.: 11/329,551

(22) Filed: Jan. 11, 2006

(65) Prior Publication Data

US 2006/0174664 A1 Aug. 10, 2006

(30) Foreign Application Priority Data

Feb. 8, 2005 (EP) ..... 05100868

(51) Int. Cl.
*D06F 39/10* (2006.01)

(52) U.S. Cl. ..... 68/18 F; 134/110

(58) Field of Classification Search ..... 134/111, 134/110; 68/18 R, 18 F; 4/679
See application file for complete search history.

(56) References Cited

U.S. PATENT DOCUMENTS

| | | | | | |
|---|---|---|---|---|---|
| 904,286 | A | * | 11/1908 | Waibel | 137/247.35 |
| 1,690,974 | A | * | 11/1928 | Hazard et al. | 134/176 |
| 1,887,781 | A | * | 11/1932 | Parr | 210/167.32 |
| 2,011,031 | A | * | 8/1935 | Birch | 210/186 |
| 2,142,888 | A | * | 1/1939 | Donnallan | 210/167.32 |
| 2,360,278 | A | * | 10/1944 | Robertson | 68/18 F |
| 2,927,451 | A | * | 3/1960 | Bochan | 68/18 F |
| 3,102,409 | A | * | 9/1963 | Paganini | 68/18 D |
| 3,228,525 | A | * | 1/1966 | Evans et al. | 210/167.01 |
| 3,466,901 | A | * | 9/1969 | Reid | 68/18 F |
| 3,590,606 | A | * | 7/1971 | Takeyama | 68/208 |
| 4,485,645 | A | * | 12/1984 | Mulder et al. | 68/18 F |
| 4,566,970 | A | * | 1/1986 | Piai et al. | 210/409 |
| 5,493,745 | A | * | 2/1996 | Hauch | 8/158 |
| 5,660,063 | A | * | 8/1997 | Lee et al. | 68/18 F |
| 6,584,812 | B1 | * | 7/2003 | Killane | 68/18 F |

FOREIGN PATENT DOCUMENTS

| | | | |
|---|---|---|---|
| DE | 43 43 044 | * | 6/1994 |
| GB | 2 190 926 | * | 12/1997 |
| JP | 2001-321596 | * | 11/2001 |
| JP | 2002-126393 | * | 5/2002 |

* cited by examiner

*Primary Examiner*—Frankie L Stinson
(74) *Attorney, Agent, or Firm*—Pearne & Gordon LLP

(57) ABSTRACT

Clothes washing machine comprising a washing tub, a drain pipe provided under said tub and connecting it with a drain pump chamber, said drain pipe comprising a central length and a final length oriented horizontally towards said drain pump chamber, a hydraulic impeller (4) provided within said drain pump chamber, wherein in correspondence to and below said final length there is arranged an auxiliary filtering chamber connected to said final length via a horizontal aperture provided in the bottom wall of said final length.

Said horizontal aperture is situated at the beginning of said final length, as viewed in the direction of flow of the liquor being let off said tub.

In a preferred manner, said auxiliary filtering chamber is provided with a bottom wall connected to said central length via a smoothly radiused union that is concave towards the interior of said central length.

2 Claims, 7 Drawing Sheets

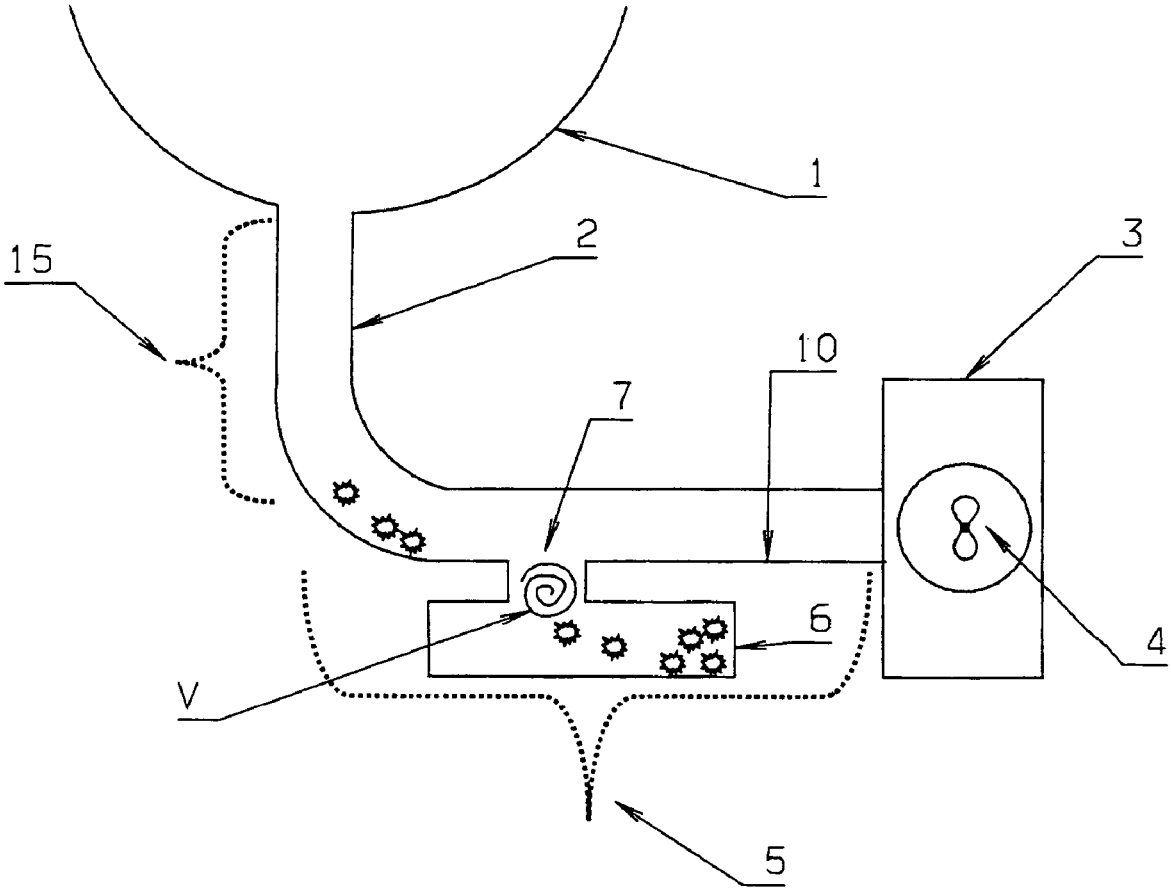
Figura 1

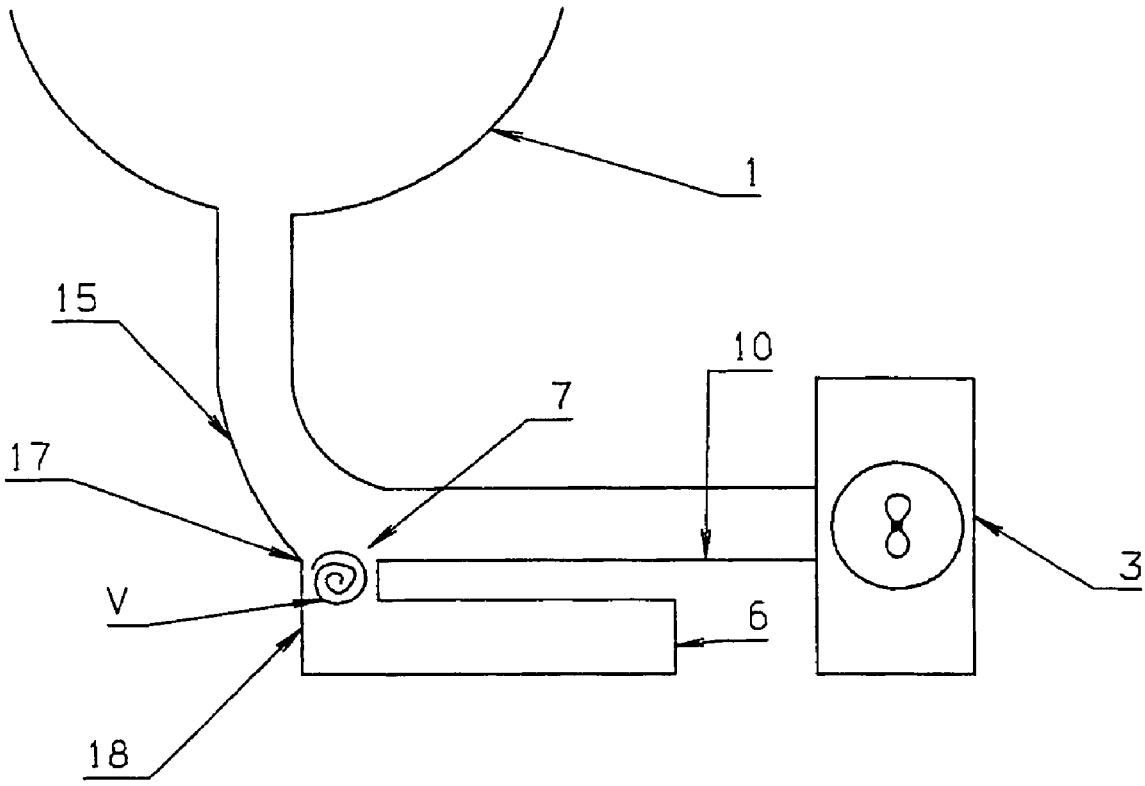
Figura 2

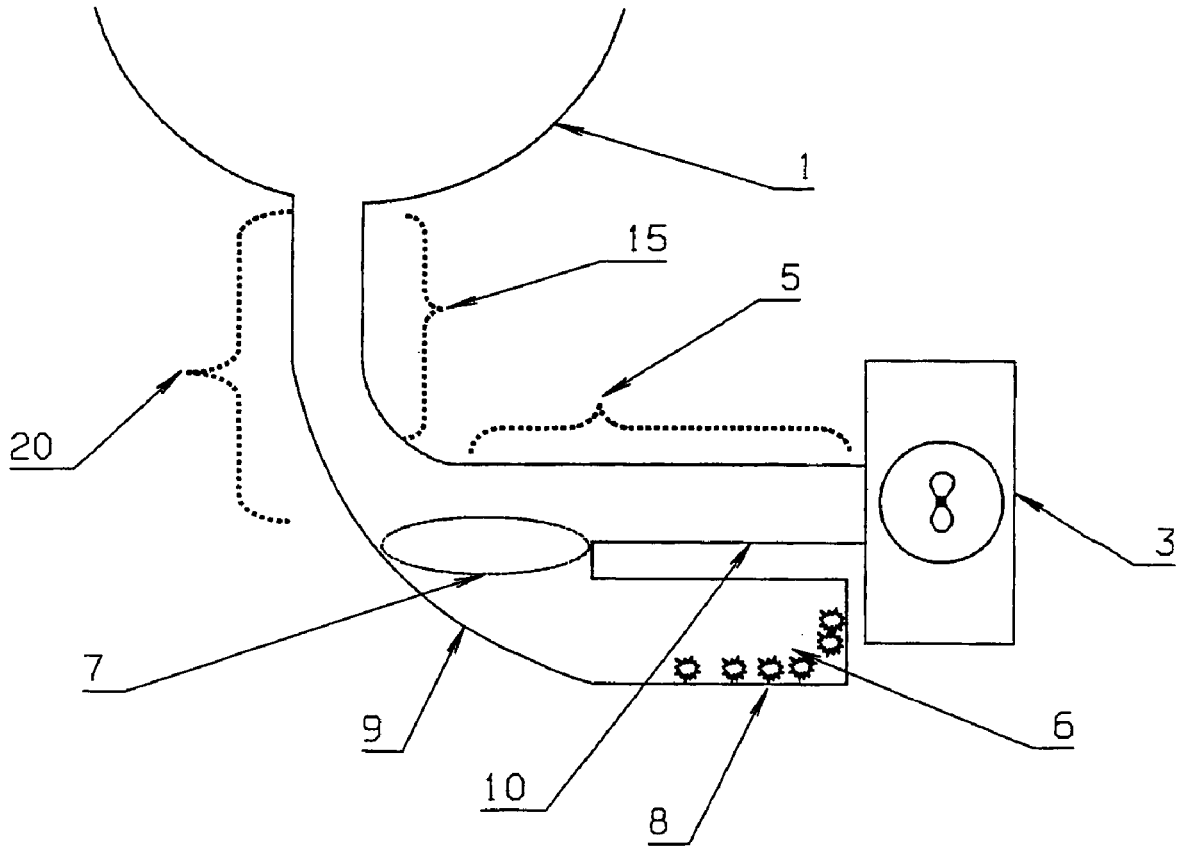
Figura 3

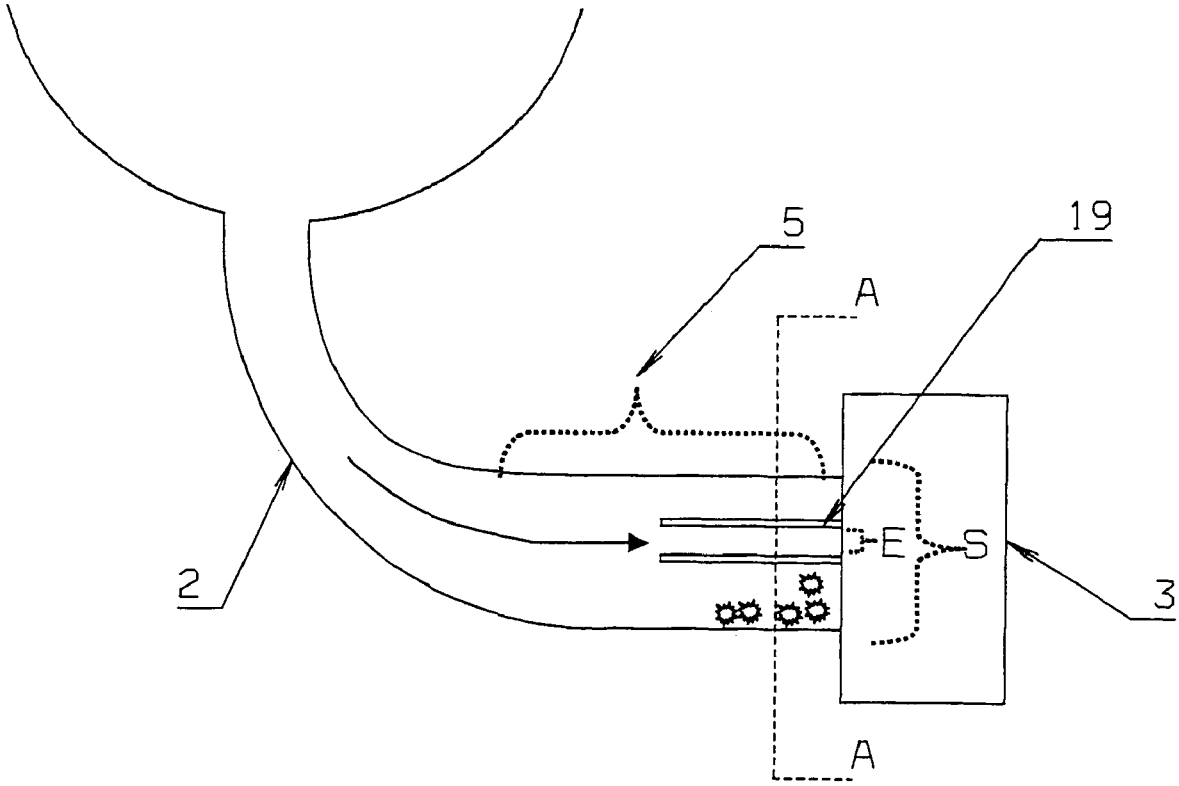
Figura 4
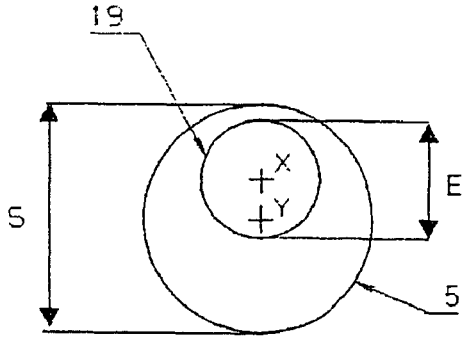
Figura 5

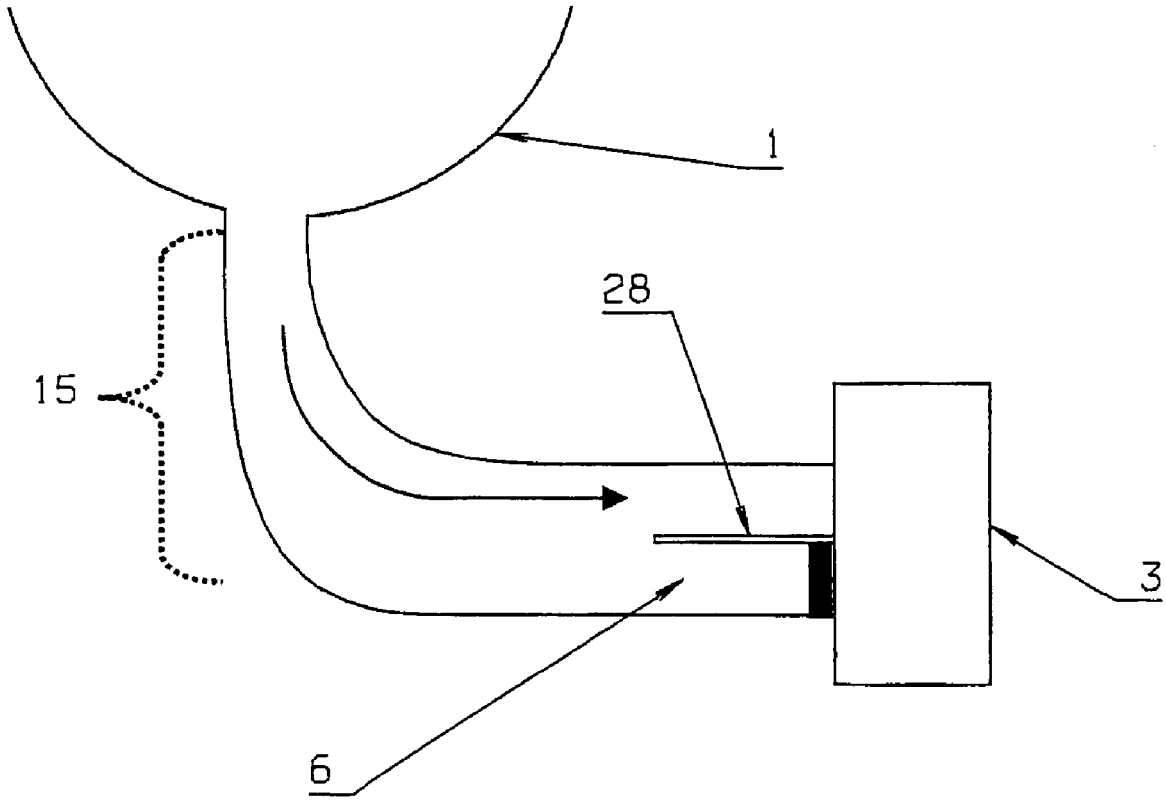
Figura 7

Fig. 9
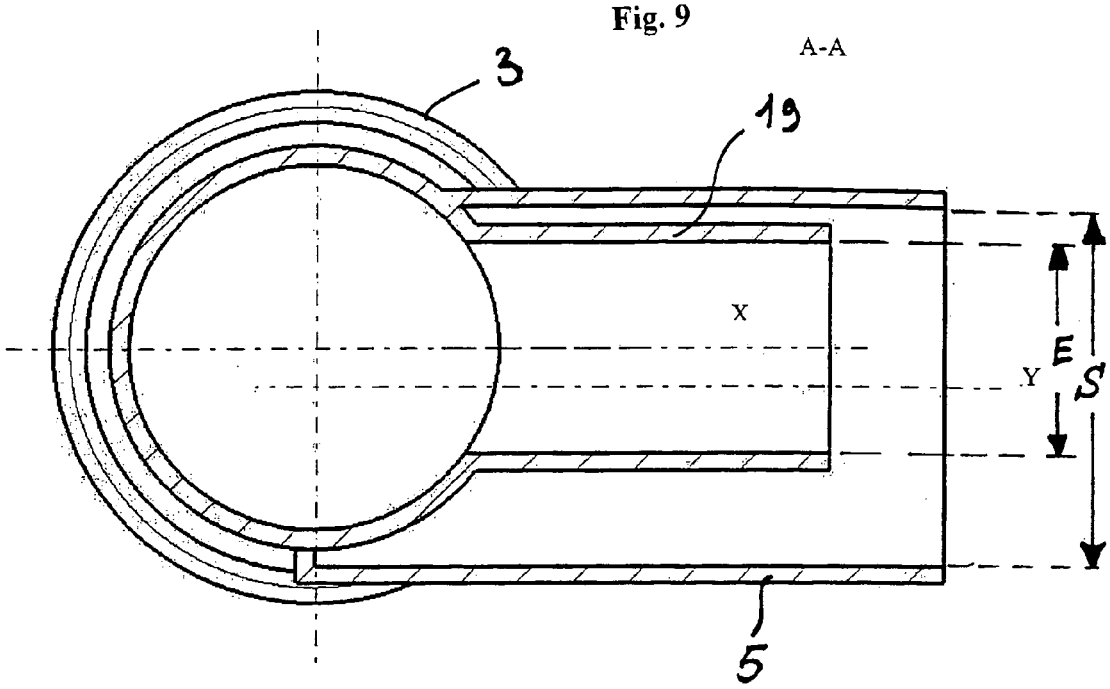
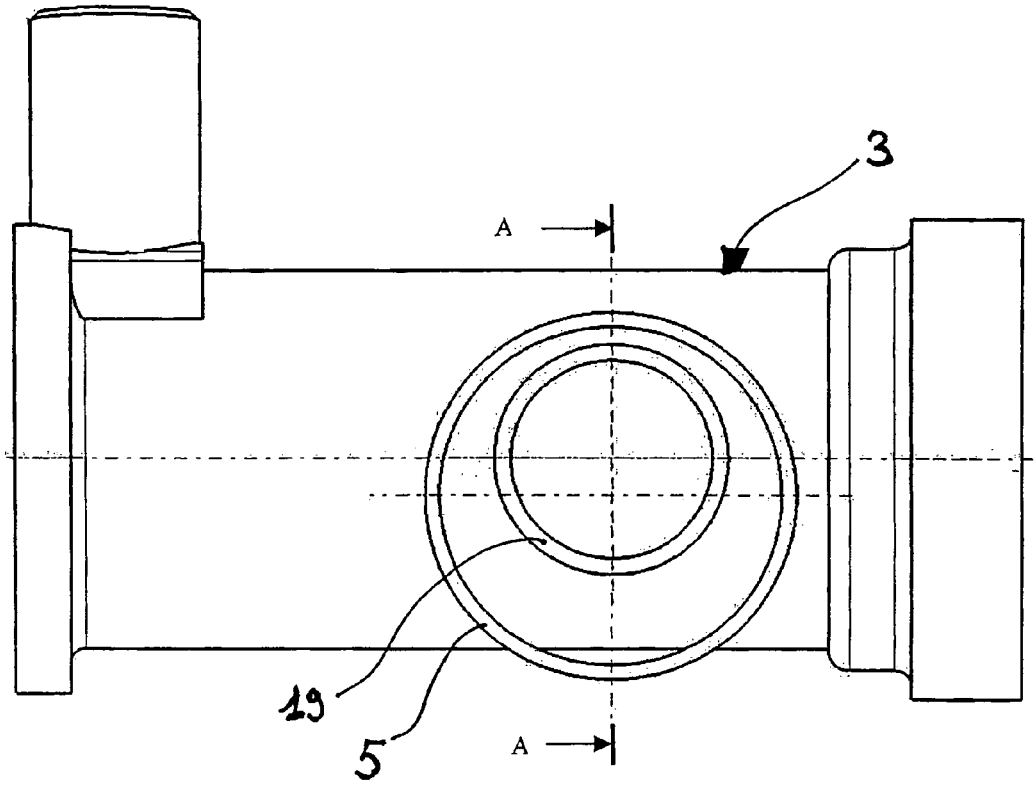
Fig. 8

CLOTHES WASHING MACHINE WITH IMPROVED FILTER ASSEMBLY

The present invention refers to an improved kind of clothes washing machine, preferably of the type intended for use in households, provided with a particularly efficient filter unit for the protection of the impeller of the drain pump.

Clothes washing machines are generally known are provided with a drain pump comprised of an impeller driven by a related electric motor; this impeller is usually housed in a corresponding drain chamber, in which there debouches a conduit extending from the bottom of the wash tub to convey the liquor to be let off into said drain chamber, and from which there departs a drain conduit that, usually through a siphon-shaped length of pipe, conveys said liquor outside the machine.

Within said drain chamber, or upstream thereof, there is generally provided a particular filtering arrangement, or more simply a filter, as it will be referred to hereinafter, with the task of intercepting and retaining coarse foreign matters that may be contained in the liquor flowing in from the tub. As a matter of fact, should these foreign matter fail to be intercepted and retained prior to reaching the impeller of the pump, they are quite likely to end up by aggregating to, i.e. clogging the impeller, thereby causing the whole pump to become stalled.

Various theories exist nowadays concerning such filter, each one of which is anyway the result of, i.e. is based on to two distinct and mutually contrasting filtering strategies:

According to a first such strategy, said filter must be very efficient, i.e. as efficient as possible, so as to prevent any matter that may clog the impeller and cause the pump to stall from being capable of passing therethrough, while on the other hand enabling only minute, absolutely harmless particles to flow therethrough to be eventually discharged by the action of the same impeller; this strategy, however, has a drawback in that the filter, especially if the machine is used in a rather careless or incautious manner, will intercept and retain a lot of foreign bodies and matters I a very short time, thereby becoming soon clogged; it largely known that the ultimate consequence of such drawback is a failure of the machine to discharge the washing liquor and, practically, its becoming inoperative.

In view of doing away with this problem, or preventing it from occurring, the filter itself must therefore be removed and cleaned very frequently and this, of course, fives in turn rise to a number of drawbacks and risky situations, as any user of a washing machine is well aware of.

According to a second filtering strategy, the filter must be such as to be able to only intercept and retain those foreign bodies and matters that would surely cause the pump to stall, or anyway are quite likely to give rise to such problem, while allowing all other bodies and matters that are not so likely to clog and lock the pump to pass therethrough; it can be readily appreciated that advantages and disadvantages of this option are exactly the reverse of those encountered with the first strategy described above, in the sense that, in the second case, the filter will require less frequent cleaning (in certain cases, even much less frequent cleaning), whereas the pump may be expected to clog and stall—and therefore need servicing—rather frequently.

Briefly, it can be stated that these kinds of problems tend substantially to arise owing to the filter being made in the form of a variously configured labyrinth arranged in series with the impeller, while then selecting between the two above-described strategies, neither of which can be regarded as being really the ideal one, i.e. opting for a rapidly clogging filter or a pump that is subject to frequent stalling.

It would therefore be desirable, and it is actually a main object of the present invention, to provide a clothes washing machine that is provided with filtering means for the liquor flowing in from the washing tub in view of being discharged outside the machine, wherein said filtering means are very efficient, featuring excellent filtering properties for retaining even very small objects, as long as these objects are heavy, and, even if they are filled up with such objects, do not involve as a consequence either the need of being frequently cleaned or the risk of preventing the machine from draining, i.e. discharging the liquor in a correct and due manner.

According to the present invention, these aims, along with further ones that shall be described further on, are reached in a clothes washing machine using a kind of drain filter that operates by gravity and is arranged in parallel to the flowpath of the liquor to be discharged, so as defined and recited in the appended claims.

Anyway, features and advantages of the present invention will be more readily understood from the description that is given below by way of non-limiting example with reference to the accompanying drawings, in which:

FIG. 1 is a median vertical sectional view of the drain pipe and the drain pump chamber in a first embodiment of a clothes washing machine according to the present invention;

FIG. 2 is a median vertical sectional view of the drain pipe and the drain pump chamber in a second embodiment of a clothes washing machine according to the present invention;

FIG. 3 is a median vertical sectional view of the drain pipe and the drain pump chamber in a third embodiment of a clothes washing machine according to the present invention;

FIG. 4 is a median vertical sectional view of the drain pipe and the drain pump chamber in a fourth embodiment of a clothes washing machine according to the present invention;

FIG. 5 is a view along the orthogonal section A-A in FIG. 4;

FIG. 7 is a view of a constructive variant of the embodiment illustrated in FIG. 3;

FIGS. 8 and 9 are side and cross-sectional views, respectively, of the arrangement shown in FIG. 6.

Figure 6:
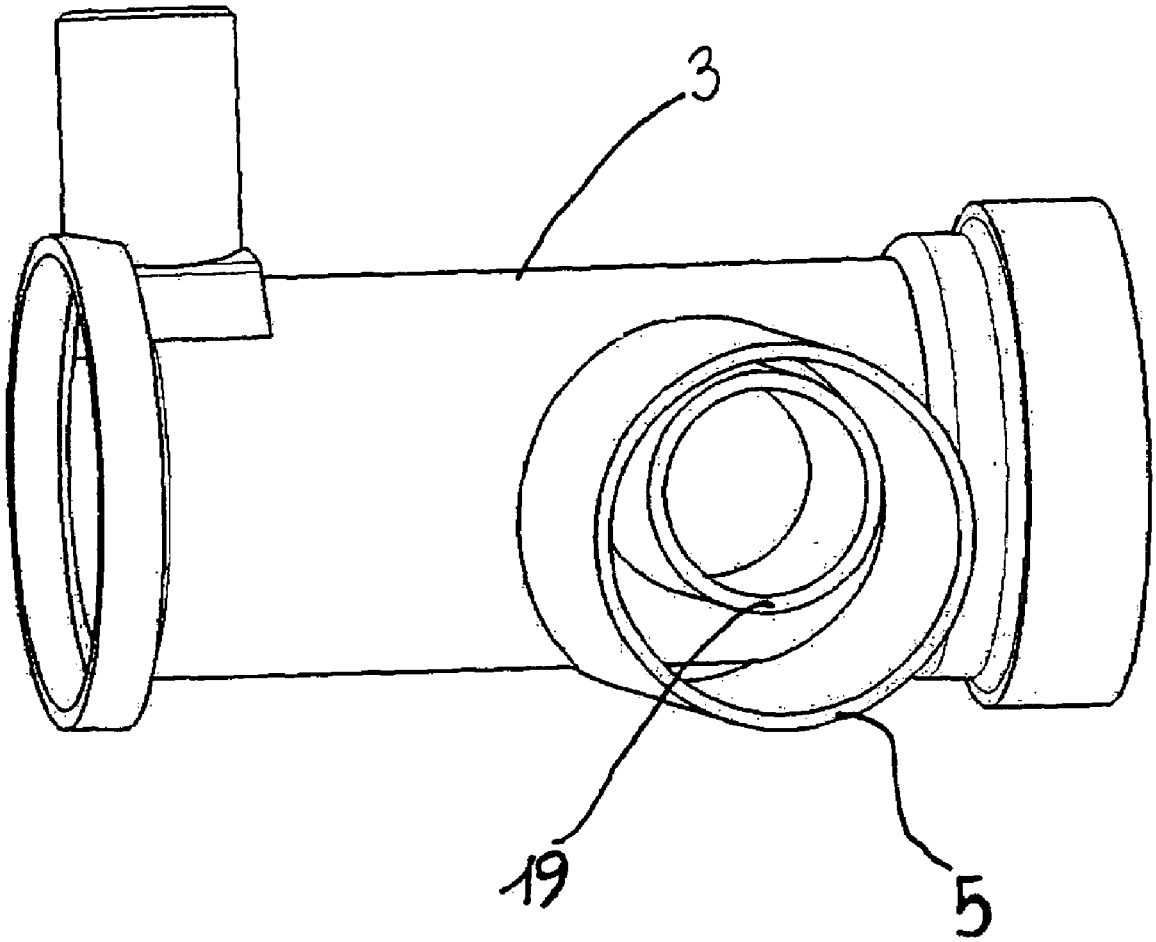
FIG. 6 is an outer perspective view of the filtering arrangement illustrated in FIGS. 4 and 5.

With reference to FIG. 1, in a clothes washing machine according to the prior art there are provided a tub 1 holding the washload, i.e. the clothes to be washed, a drain pipe 2 that branches off, with its upper portion, from the bottom of said tub and connects the latter with a drain pump chamber 3 located at the lower end portion thereof; by its own nature, said drain pipe is at least partially oriented downwards, since it must collect the liquid flowing from the bottom of the tub by gravity, and it comprises a central portion 15, which is inclined or oriented downwards, and a final portion or length 5 that joins with said drain pump chamber 3 and extends in a substantially horizontal manner.

Within said drain pump chamber there is provided, in a per se known manner, a hydraulic impeller 4 driven by an electric motor (not shown).

According to the prior art, the drain filter is arranged in series with the flowpath of the liquor being conveyed through said drain pipe and reaching said impeller and, hence, it lies either in the drain pipe itself or within the drain pump chamber 3.

In departure from this configuration, according to the present invention the filter is not arranged in series to the flowpath of the liquor, but rather in parallel thereto; in particular, it is arranged in parallel to said final length 5, in a zone lying therebeneath.

For it to be capable of working, said filter does by no means require to be made in any special manner whatsoever, but is most simply constituted by a pocket 6, which is closed at an end portion thereof and works as an auxiliary filtering chamber; the latter is open upwards through an aperture 7, which connects it to an opening in the bottom wall 10 of said final length 5 of pipe. Thanks to the particular location thereof and the provision of said vertically oriented aperture 7, said auxiliary filtering chamber 6 is able to spontaneously intercept, retain and collect any foreign body and matter that may be carried in the flow of the liquor being let out, since these bodies and matters carried by said liquor simply fall thereinto by gravity when passing by said aperture 7.

To this purpose, said auxiliary filtering chamber 6 must be situated, i.e. lie underneath said final length 5 of pipe, which in turn must in a preferred way be horizontal, but may be also inclined, although this would of course reduce its effectiveness, since the cross-sectional area on the horizontal plane of the aperture 7, which is what really matters for the force of gravity to be able to work in the due manner, decreases with the inclination of said aperture approaching the vertical.

With reference to FIG. 2, an improved embodiment of said auxiliary filtering chamber 6 is provided by having said aperture 7 situated at the beginning of said final length of pipe, as well as by sizing said auxiliary filtering chamber 6 so that it extends forwards from said aperture 7 in the direction of and under said final length of pipe, so as to be able to make the most out of the internal volume thereof, since the objects that fall thereinto by gravity obviously have a velocity component in the direction of said final length of pipe and, hence, they tend to spontaneously heap up therebelow.

With reference to FIG. 3, a further improved embodiment of said auxiliary filtering chamber 6 consists in giving it a shape so that the bottom wall 8 thereof joins with a smooth radius 9 with the remaining part of said drain pipe 2, wherein the wall 20 of the latter acts in particular so as to partially delimit said aperture 7; this improvement, in fact, creates a concavity towards the interior of the central length 15 of the drain pipe, or towards the portion thereof that joins with the final length of the same drain pipe, so as to make it easier for lighter objects and matters to be intercepted and retained within said auxiliary chamber 6, owing to said aperture 7 being in this way significantly enlarged; in addition, the eddy or vortex V forming towards the bottom, immediately downstream of the corner 17 between said central length 15 of the drain pipe and the vertical portion 18 of the auxiliary chamber 6, as this is best shown schematically in FIG. 2, is eliminated.

With reference to FIG. 7, the present invention might substantially be represented also in the form of a drain manifold or pipe 2, which grows sensibly larger as it moves downwards, while being however provided in its terminal portion with an intermediate wall 28 that cuts it horizontally, so as to separate said drain pipe into two distinct cavities lying upon each other, wherein the upper cavity corresponds to the final length 5 of the pipe flowing into the drain pump chamber 3 and the lower cavity forms the above-mentioned auxiliary filtering chamber 6.

With reference to FIGS. 4 and 5, a further improved embodiment of said auxiliary filtering chamber 6 consists in providing a drain manifold or pipe 2 which has, in its final length, an inside cross-sectional area S that is suitably increased as compared with the inflow mouth E of the drain pump chamber 3, while arranging around said inflow mouth E a cylindrical member 19 that:

is open at both bases thereof, has a base thereof applied against and around the rim of said inflow mouth E, and has its axis that extends substantially parallel to the axis of said final length 5 of the drain pipe.

In practice, said drain pipe and said cylindrical member are two substantially cylindrical elements having parallel, but not coaxial axes, in which said final length 5 comes to be situated substantially outside said cylindrical member 19.

In this way, the cavity forming between said drain pipe 2 and said cylindrical member 19 contained therein takes the form of an elongated, horizontally extending "crown", thereby providing in an easy and reliable manner an improved embodiment of said auxiliary filtering chamber 6. The advantage of this construction lies in the fact that said auxiliary filtering chamber becomes in this way much more effective in intercepting and retaining not only the heavier bodies and matters that that tend naturally to collect downwards onto the bottom, but also smaller and, therefore, lighter matters and particles, such as buttons, toothpicks, fabric fragments, and the like, which on the contrary do not tend to unfailingly fall downwards, so that they would not be reliably intercepted with the other embodiments of the present invention, but are on the contrary more easily and effectively caught and retained by said auxiliary filtering chamber having the above-described crown-like shape.

In an advantageous manner, said horizontal cylinder 19 is positioned in the upper portion of said final length of drain pipe, so that its axis X extends substantially parallel to, but at a higher level than the axis Y of said final length 5; this enables said auxiliary filtering chamber 6 to preserve a good intercepting, retaining and collecting ability as far as the heavier foreign bodies and matters are concerned, which are the majority of the debris in the liquor being let off a washing tub, while anyway ensuring a good effectiveness in intercepting and retaining also lighter bodies and matters that are generally found at the periphery of the flow of liquor moving down said drain pipe 2.

The invention claimed is:

1. Clothes washing machine comprising:

a clothes holding and washing tub (1), a drain manifold or pipe (2) provided under said tub and connecting the internal volume of said tub with a drain pump chamber (3), said drain pipe comprising a central length (15) and a final length (5), in which said final length (5) extends towards and into said drain pump chamber in a substantially horizontal direction, a hydraulic impeller (4) provided within said drain pump chamber and driven by an appropriate electric motor, filtering means for the liquor descending through said drain pipe and comprising an auxiliary filtering chamber (6) underneath said final length of said drain pipe extending into the drain pump, the internal volume of said auxiliary filtering chamber being connected to said final length, wherein said auxiliary filtering chamber (6) is formed by the cavity intervening between said final length (5) and a horizontal cylinder (19) arranged inside said final length (5), and that said horizontal cylinder (19) and said final length (5) have their axes (X, Y) extending parallel to each other, but offset relative to each other.

2. Clothes washing machine according to claim 1, wherein the axis (Y) of said final length (5) extends at a lower level than the axis (X) of said horizontal cylinder (19).

* * * * *